US007318760B2

(12) United States Patent
Jesadanont et al.

(10) Patent No.: US 7,318,760 B2
(45) Date of Patent: Jan. 15, 2008

(54) MECHANISM FOR TRANSFERRING TOTAL WEIGHT OF OUTBOARD ENGINE FROM BOAT AND SHIP

(76) Inventors: Mongkol Jesadanont, 386/2 Ratchadaphisek 42, Ratchadaphisek Road, Chatuchak, Bangkok (TH) 10900; Apijade Jesadanont, 386/2 Ratchadaphisek 42, Ratchadaphisek Road, Chatuchak, Bangkok (TH) 10900; Sukanya Nimmannit Jesadanont, 286/2 Ratchadaphisek 42, Ratchadaphisek Road, Chatuchak, Bangkok (TH) 10900

( * ) Notice: Subject to any disclaimer, the term of this patent is extended or adjusted under 35 U.S.C. 154(b) by 0 days.

(21) Appl. No.: 11/439,038

(22) Filed: May 24, 2006

(65) Prior Publication Data

US 2007/0275612 A1 Nov. 29, 2007

(51) Int. Cl.
*B63H 5/20* (2006.01)

(52) U.S. Cl. ..... 440/53; 114/280

(58) Field of Classification Search ..... 114/271, 114/272, 273, 274, 278, 280, 282; 440/53, 440/61 R See application file for complete search history.

(56) References Cited

U.S. PATENT DOCUMENTS 1,823,735 A 9/1931 Glasby
3,207,120 A 9/1965 Verdi
3,522,785 A 8/1970 Thompson
4,056,074 A * 11/1977 Sachs ..... 114/280
4,482,330 A * 11/1984 Cook ..... 440/61 R
4,890,811 A * 1/1990 Ehni ..... 440/61 R
4,995,839 A * 2/1991 Havins ..... 440/53
5,017,165 A * 5/1991 Havins ..... 440/53
6,398,600 B1 6/2002 Lawson
6,409,556 B1 * 6/2002 Vance ..... 440/61 R
6,439,148 B1 8/2002 Lang
6,892,665 B2 5/2005 Jesadanont et al.

* cited by examiner

*Primary Examiner*—Lars A. Olson

(57) ABSTRACT

A mechanism for transferring total weight of outboard engine from a boat to be loaded onto water surface comprises mainly of two parts, first part is to be fixed to the boat and second part to be fixed to an engine where the second part connected to the first part through a connecting component controllable in such a manner that the second part can either move freely vertically or fixed tightly relative to the first part while the first part is stationary to the boat. There is ski structure at the lower end of second part to help carrying weight of the engine and to pass the load onto the water surface while the boat is moving at high speed.

5 Claims, 11 Drawing Sheets

MECHANISM FOR TRANSFERRING TOTAL WEIGHT OF OUTBOARD ENGINE FROM BOAT AND SHIP

BACKGROUND OF THE INVENTION

This invention relates to mechanism for transferring the weight of an outboard engine from a boat yet the engine still functions to push the boat forward. This helps that any boat or ship which uses this mechanism needs not carry load of the engine whose weight is mostly the heaviest component of a boat. This is a revolution of using an engine to drive a boat or ship forward. Thus, boat can move efficiently and fuel utilization can be minimized.

Especially, when this mechanism is installed in a 'Smart Flying Boat' of Mongkol Jesadanont et al. (U.S. Pat. No. 6,892,665), it would help reducing the size of the flaps mounted to the boat and allow flying of the boat above water surface more rapidly and efficiently.

SUMMARY OF THE INVENTION

A mechanism is invented for transferring weight of an outboard engine from a boat or a ship to be loaded onto water surface through a ski structure while the boat is moving very fast or flying above water surface and while the engine still pushes the boat forward. Boat needs not carry the entire weight of the engine since all the engine weight is transferred to water through the ski structure. The mechanism comprises mainly of two parts, first part is to be fixed to the boat and second part to be fixed to an engine where the second part connected to the first part by a connecting component controllable in such a manner that the second part can either move freely vertically or fixed tightly relative to first part and while first part is stationary to the boat. There is ski structure at the lower end of second part to help carrying weight of engine and to pass the load onto the water surface when moving at high speed where propelling means locates underneath the ski structure.

DETAILED DESCRIPTION OF THE PREFERRED EMBODIMENTS

This invented mechanism for transferring entire weight of an engine from a boat or ship is to be used only with engine of outboard type.

All types of engine, either outboard engine or inboard engine currently used must be first modified before assembling to this mechanism invented.

There are three kinds of engine to be modified:

1. Outboard Engine

Figure 1:
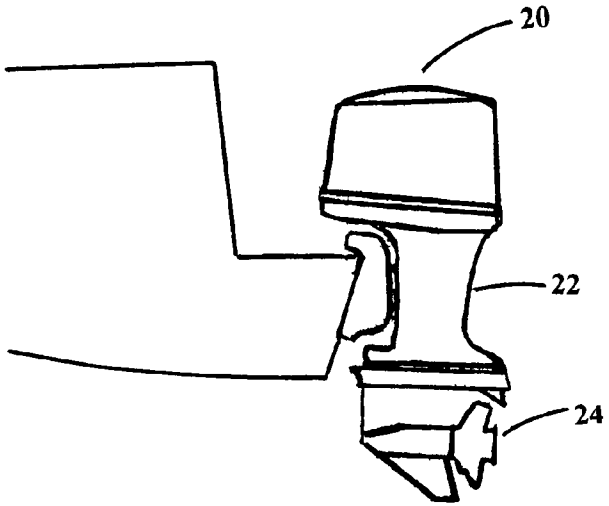
FIG. 1 is a conventional outboard engine to be attached to the outside at the rear of a boat.

As in FIG. 1, stem 22 of engine 20 is extended by placing element 23 in between stem 22 and propeller unit 24.

Figure 2:
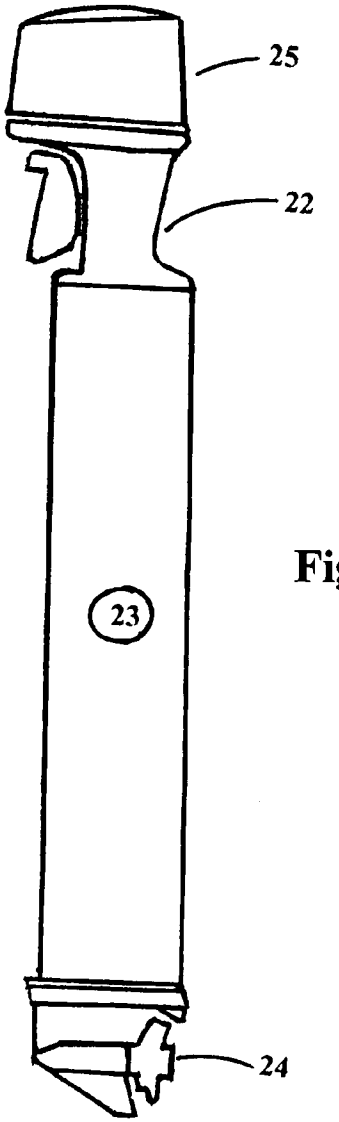
FIG. 2 is a modified outboard engine with its stem extended longer.

Engine 20 then becomes engine 25 as in FIG. 2 with slight modification within the engine.

In principle, this is a type of engine of high speed (but not higher than 5,500 round per minute, rpm) yet not efficient enough to allow flying of a boat above the water surface since the propeller of this type of engine drive directly in the water. Thus, acceleration of speed above 5,500 rpm, propeller rotates freely in the water with not enough driving force to push the boat forward. The propeller itself even acts against moving of the boat forward.

Theoretically, smart flying boat of U.S. Pat. No. 6,892,665 can make a greater speed in flying above water surface than to use this type of engine.

Thus, for efficiency, engine type of water jet engine is needed which is an inboard engine used in jet ski boat. This type of engine is with very high speed (5,500-12,000 rpm) which is the best to be used to allow flying of boat above water surface.

Figure 3:
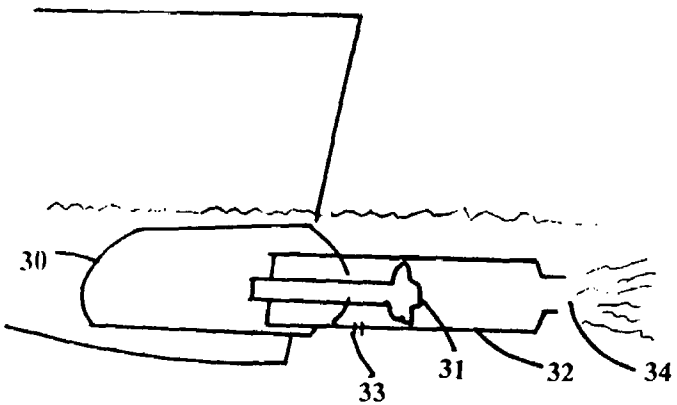
FIG. 3 is a conventional inboard water jet engine used in a boat.

2. Water Jet Engine which is an inboard engine installed inside a conventional jet ski boat. This type of engine has to be modified as follows:

FIG. 3 shows a jet ski boat using water jet engine 30 to drive the boat forward where the engine rotates propeller 31 inside tube 32. When propeller 31 rotates at very high speed (5,500-12,000 rpm.), water is drawn into tube 32 through inlet 33 and jetted out of nozzle 34 at very high speed powerfully to move the boat forward with a speed much greater than when an engine of high speed like that of 1 is used.

Figure 4:
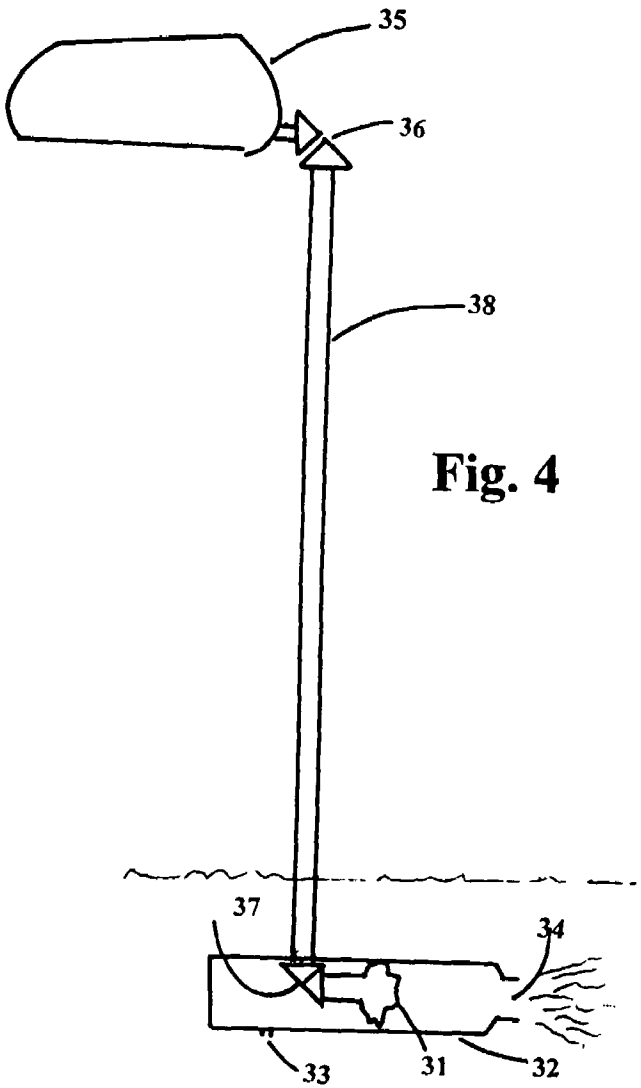
FIG. 4 is an outboard water jet engine modified from the inboard water jet engine of FIG. 3.

The inboard water jet engine 30 as in FIG. 3 is modified to outboard jet engine 35 as in FIG. 4 where engine transmits power through gear units 36 and 37 to rotate propeller 31 and where the length of stem 38 is extended to a length equals to that of stem 22 plus element 23 as in FIG. 2.

When in use, tube 32 and nozzle 34 must be under water.

Figure 5:
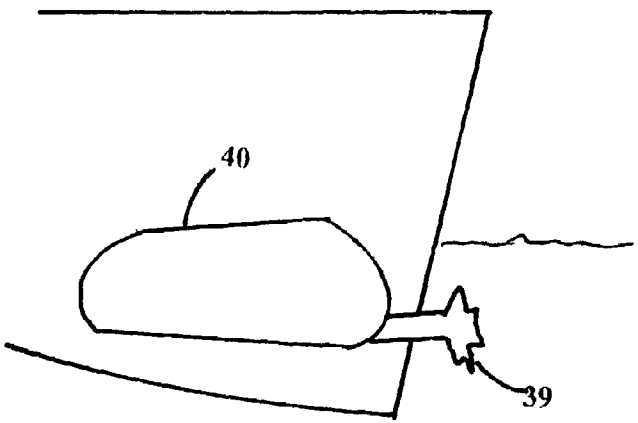
FIG. 5 is a conventional inboard engine used in a boat.

3. Inboard Engine 40 which is normally installed inside a boat as in FIG. 5.

Figure 6:
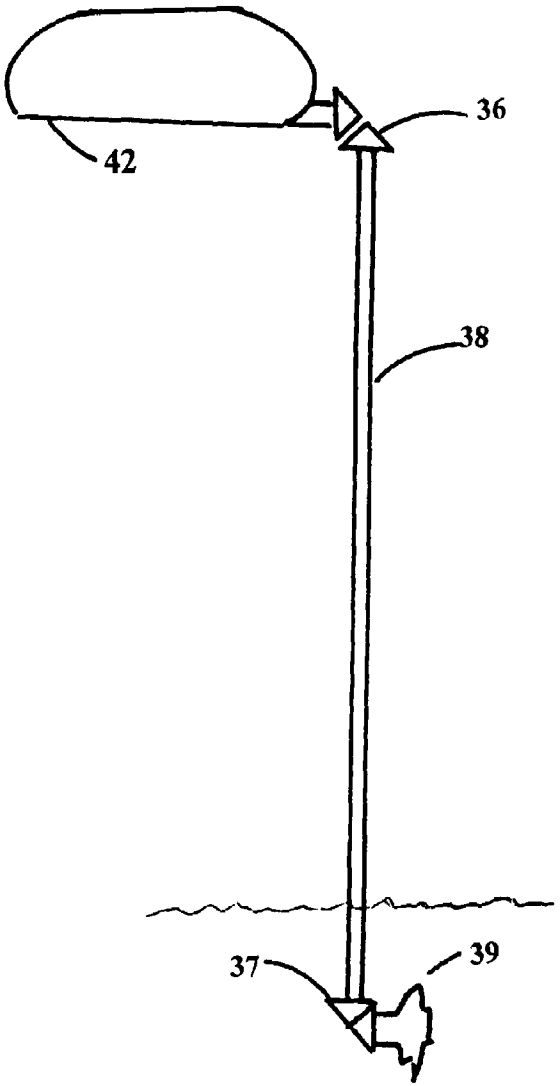
FIG. 6 is an outboard engine modified from the inboard engine of FIG. 5

Inboard engine 40 is modified to become an outboard engine 42 as shown in FIG. 6. where its power is transmitted through gear units 36 and 37 to rotate propeller 39 and the length of stem 38 is extended in similar manner as in 2.

The difference between engine 42 and engine 25 and 35 is that engines 25 and 35 use gasoline thus is of high and very high speed; however, they are of low power and lighter weight what available is not greater than 300 horsepower (hp) and not greater than 300 kilogram. These two types of engine are for vessels of smaller size with lighter load yet with high or very high speed, i.e. over 50 knots or 90 km/hr. At this high velocity, flaps installed to a boat would help lifting a boat of lighter weight, perhaps, not greater than one ton to fly above the water surface more easily.

Engine 42 which is modified from inboard engine 40, however, is of diesel type with low speed. Its speed is normally not greater than 3,500 rpm but of greater power, for instance, 5,000 hp with weight of approximately 5000 kilograms or 5 tons. This type of engine is good for vessels of big or very big size with very heavy load. Its speed is quite slow i.e. not greater than 35 knots or 65 km/hr. For this type of vessel, there is no need to install flap as no matter how high the speed is, the vessel can not be lifted above the water surface. Yet, using the presently invented mechanism would help that boat would bear less weight of engine than it really needs to do. Thus, any types of vessel, either the one can fly or can not fly above the water surface if with enough speed to have ski move along the waterline, can use this mechanism to transfer the load of its engine onto the water surface through a ski structure.

The modified engines according to 1-3, when being installed to the presently invented mechanism it has to be in the type of outboard engine such that it can be moved vertically upward and downward during operation.

Figures 7, 8:
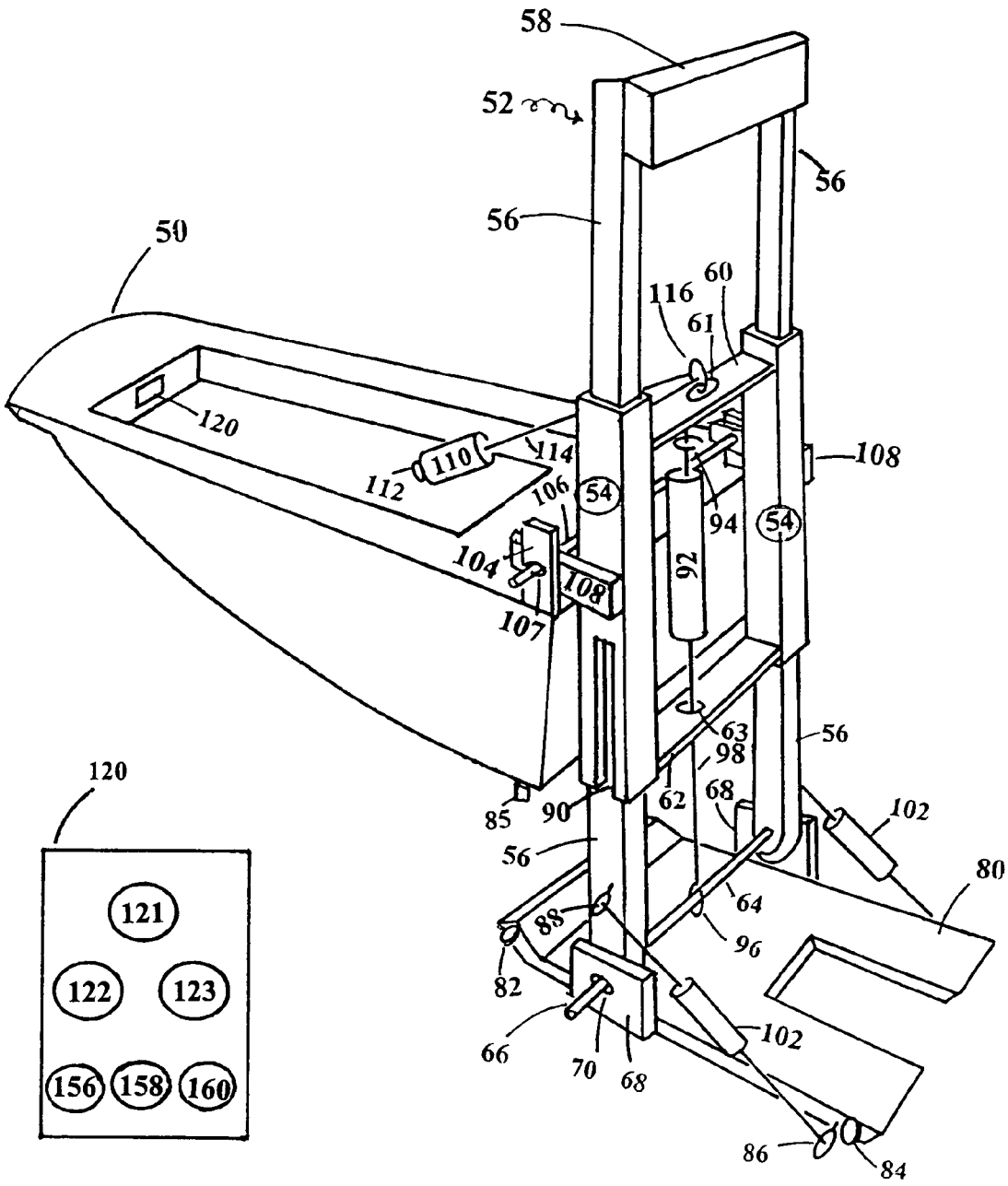
FIG. 7 is a mechanism of the present invention for transferring the entire weight of an outboard engine off a boat.
FIG. 8 is a control panel showing different light bulbs.

Steps of assembling are as follows:

Mechanism 52 of the present invention as shown in FIG. 7 comprises of 2 main parts as follows:

1. Part I: to be mounted to rear part of a boat. This part is stationary and composed of 2 rectangular metal tubes 54 preferably stainless steel, 2 steel plates 108, a thick steel plate 60, a thick steel plate 62, first hydraulic element 92 and second hydraulic 110. The weight of part I all is carried by the boat at its stem through steel plates 108.

2. Part II: for mounting of engine thereto. This part can move vertically upward and downward relative to part I and is composed of two rectangular steel shafts 56 and all the other components fixed to the two steel shafts. Total weight of this part II will be carried by the boat if there is hydraulic fluid and pressure in hydraulic element 92. On the other hand, if there is no hydraulic fluid or pressure in hydraulic element 92, the boat will not carry the weight of part II. In other word, the boat carries part II through hydraulic element 92 only when there is hydraulic fluid and pressure in the hydraulic element.

As shown in FIG. 7, the present invention—mechanism 52 comprises two rectangular metal tubes 54 having in each metal tube a rectangular shaft 56 where shaft 56 can move up and down vertically in metal tube 54. The upper portion of the two rectangular shafts 56 connected to each other with steel plate 58.

The upper part of modified engine is mounted to this steel plate 58.

Thick steel plate 60 connects the upper part of the two rectangular metal tube 54, while thick steel plate 62 connects their lower ends.

The lower ends of the two shafts 56 are connected through steel rod 64 whose two ends 66 extended sidewise of shaft 56 pass through cavities 70 of thick steel plates 68 to allow free rotation of steel plates 68 about ends 66.

Ski 80 made of light durable material is mounted to the lower ends of steel plates 68.

Switch 82 is mounted to front curving end of ski 80.

Switch 84 is mounted to rear straight end of ski 80.

Switch 85 is mounted to lowest point under boat hull at its rear end.

Switches 82, 84 and 85 function when they are immersed under the water to turn on light bulbs 121, 122 and 123, respectively, on the control panel 120 as shown in FIG. 8 to light up. When these switches are lifted above water surface, These light bulbs turn off.

Rings 86 are fixed at posterior ends both sides of ski 80.

Rings 88 are fixed at outer lower ends of both rectangular shafts 56 just above steel plates 68.

When shafts 56 move upwards, rings 88 may move into groove 90 of tubes 54.

Hydraulic element 92 locates between steel plates 60 and 62 by being hung from mid point of plate 60 through hook 94.

Hook 96 at the end of stem 98 of hydraulic element 92 holds steel rod 64 at its midpoint where stem 98 passes through cavity 63 of steel plate 62.

Ski 80 is pushed or pulled to turn to a desired angle by hydraulics 102 connecting between rings 86 located sidewise at the posterior of the ski and rings 88 at rectangular steel shafts 56 just above steel plate 68.

Steel plates 104 are mounted upright at the rear end of boat 50 on each side.

Steel rod 106 connects two steel plates 108.

Each steel plate 108 is mounted to rectangular metal tube 54 on each side and can turn pivotally around rod 106 which has its ends pass through cavities 107 of steel plates 104.

Hydraulic element 110 connects to the deck at position 112 where ring 116 at the end of its stem 114 mounted to cavity 61 of steel plate 60.

When the boat driver presses a switch to pump hydraulic fluid into the hydraulic. This causes varying of the length of stem 114 which is under control of hydraulic element 110 to extend to a particular length as desired.

This hydraulic element 92 is key element in the present invention. It functions to transfer total weight of engine from boat. When there is fluid in hydraulic element 92, there will be pressure within hydraulic cylinder which causes the hydraulic element to connect part II tightly to part I. In this situation, boat carries total weight of engine and mechanism 52 through stem 98 where hook 96 of part I holds weight of part II and engine and where steel plates 108 is the part that carries mechanism 52 and total weight of engine. Thus, the boat carries total weight of the engine. That is, part II is connected to part I at the point hook 96 holds rod 64 when there is fluid and pressure in hydraulic element 92 where moving of part II vertically relative to part I can be readily controlled to fix tightly at any level as desired. Once there is no fluid in hydraulic 92, part II is then disconnected from part I.

Figure 9:
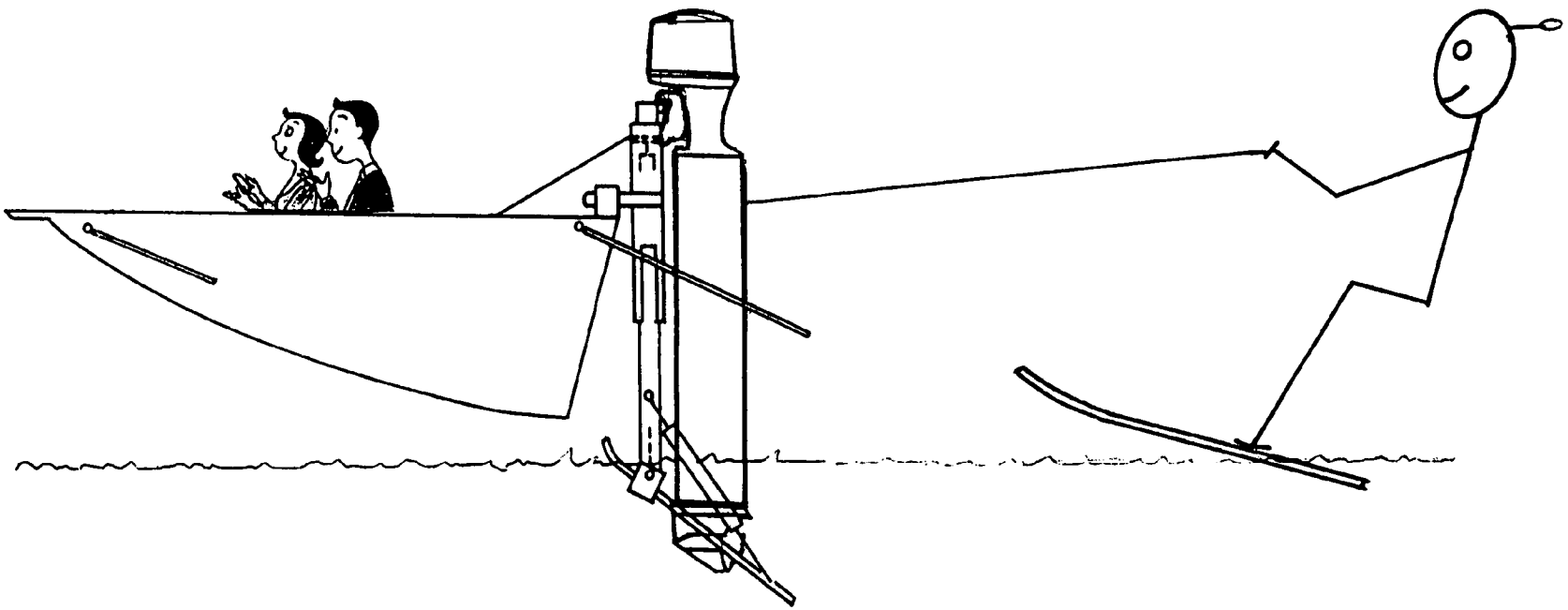
FIG. 9 is a man on water skis comparable to the manner the mechanism of this invention carries the weight of the engine.

That is, if there is no fluid and pressure in the hydraulic element 92, stem 98 and hook 96 can not hold part II of mechanism 52 to part I. The two rectangular steel shafts 56 thus slide vertically and freely up and down inside the rectangular metal tubes 54. In this situation, the total weight of engine together with part II of mechanism 52 is not held by the boat. While ski 80 is moving fast on water surface, the engine load is on the ski and water surface takes all the load of engine weight on the ski having propelling means locates underneath the ski. This is just like a man is skiing on water surface as in FIG. 9 where all his weight is carried by ski and transferred to water surface. Propelling means may be of any types of propulsion mechanisms such as propeller, water jet propulsion or any means having appropriate driving force.

Therefore, when there is hydraulic fluid in hydraulic element 92, part I and part II are connected to each other through hook 96 of part I to the midpoint of rod 64 of part II. When there is no fluid, they are disconnected from each other.

Mechanism 52 is thus composed of two main components. The first part or part I is installed stationary and tightly to the rear of the boat. The second part or part II is connected to the first part through a connecting component in the manner that second part can either be held tightly to first part or second part moves vertically and freely relative to first part. This is achieved by having a connecting component, preferably, a hydraulic element, whose function can be controlled instantaneously. While there is hydraulic fluid and pressure in hydraulic cylinder, second part is held tightly and stationary to first part. But when fluid is exhausted from the hydraulic cylinder, there is then no force thus allowing second part to move freely up and down vertically relative to first part. In such latter situation, rectangular steel shafts of second part move freely up and down inside rectangular metal tubes of first part. The total weight of engine is then loaded onto the ski structure of second part with its propelling means locates underneath the ski, and while boat is moving fast engine weight is thus loaded to water surface that boat needs not carry the engine weight any further. Engine still continuously pushes the boat forward.

If engine 25, 35 or 42 is installed to steel plate 58, while boat is not moving, let hydraulic element 92 lift engine to a level that lower side of ski 80 touches water surface. Hydraulic element 102 moves ski that switch 84 just slightly immerses under water surface.

Light bulb 122 at control panel 120 as in FIG. 8 thus lights up. Switch 82 is still above water surface but switch 85 immerses under water surface to cause only light bulb 123 lights up.

In this situation, propeller unit 24, tube 32 and propeller 39 which are underneath ski 80, also slightly immerse under water surface.

Figure 10:
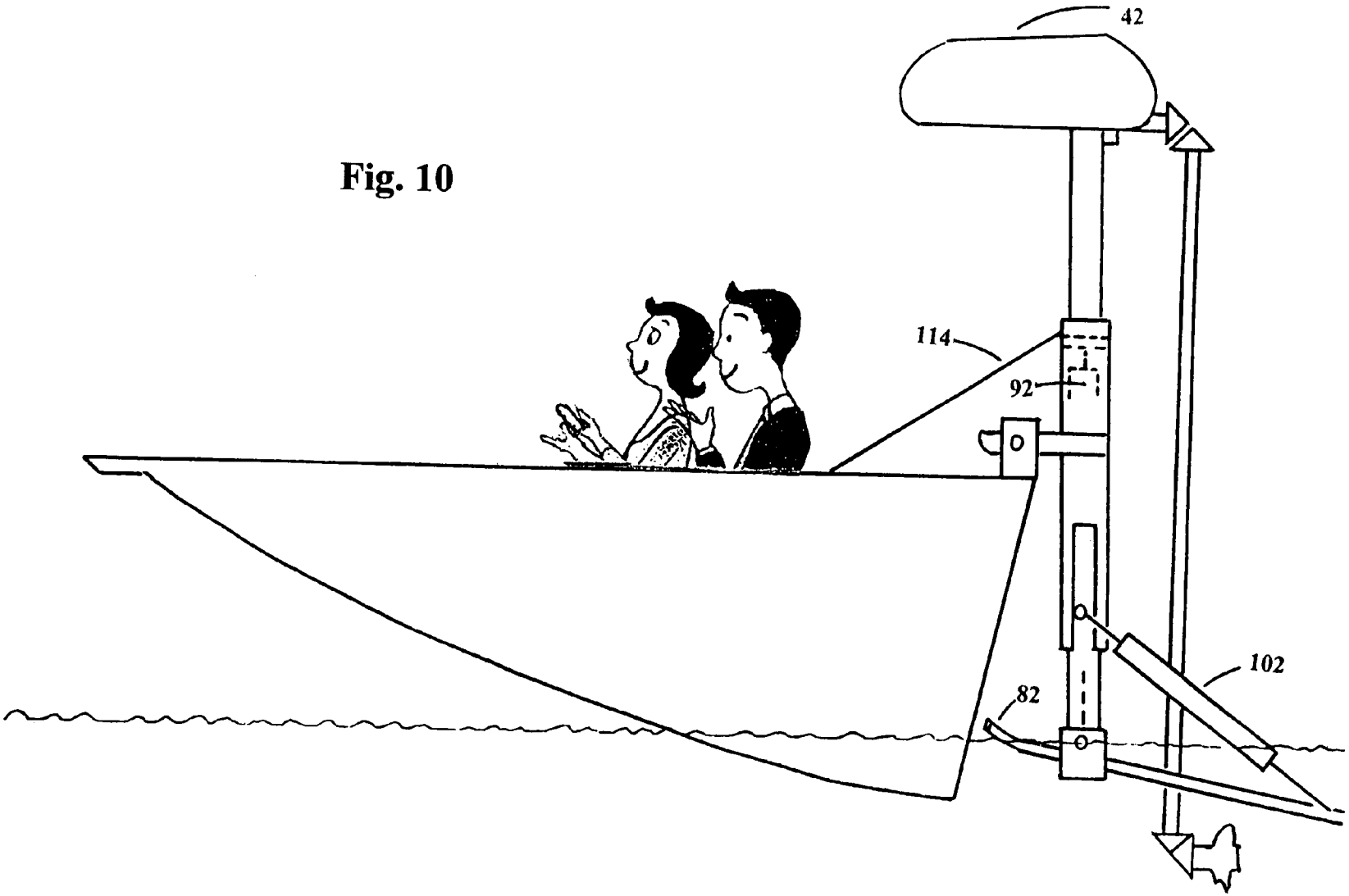
FIG. 10 is a side view of a boat which can not fly above water surface showing installation of a modified engine to this invented mechanism.

If, as in FIG. 10, the engine mounted to steel plate 58 is engine 42 which is of diesel type with lower revolution is installed to boat 50 with no anterior or posterior flaps on the boat. Since engine 42 is of slower type, thus it can not make to a speed high enough to lift the whole boat up above water surface even though flaps either front and back are installed.

While accelerating the speed of engine 42, hydraulic element 102 is simultaneously controlled that ski 80 gradually lifts its front up. This hydraulic element 102 helps adjusting the angle ski 80 makes relative to waterline. Adjusting of angle of ski is possible at all time during movement of boat at considerably high speed to have best uplift of ski by water underneath. At this velocity, a switch is pressed to allow flow of all the hydraulic fluid out from hydraulic 92 to be kept in hydraulic fluid tank.

At this point, pressure inside hydraulic 92 equals zero, i.e. hydraulic element 92 is powerless and can not carry the weight of engine loaded on the ski any longer. Yet ski 80 is still moving with good speed on water surface at all time with supporting from water underneath ski. Part II is free from part I and thus total engine weight is transferred from being carried by boat to be loaded onto ski and thus is carried by water underneath. Boat is then moving forward with no load of engine to carry, yet the engine 42 which is mounted to steel 58 is capable of pushing the boat to move forward horizontally at all time.

Figure 11:
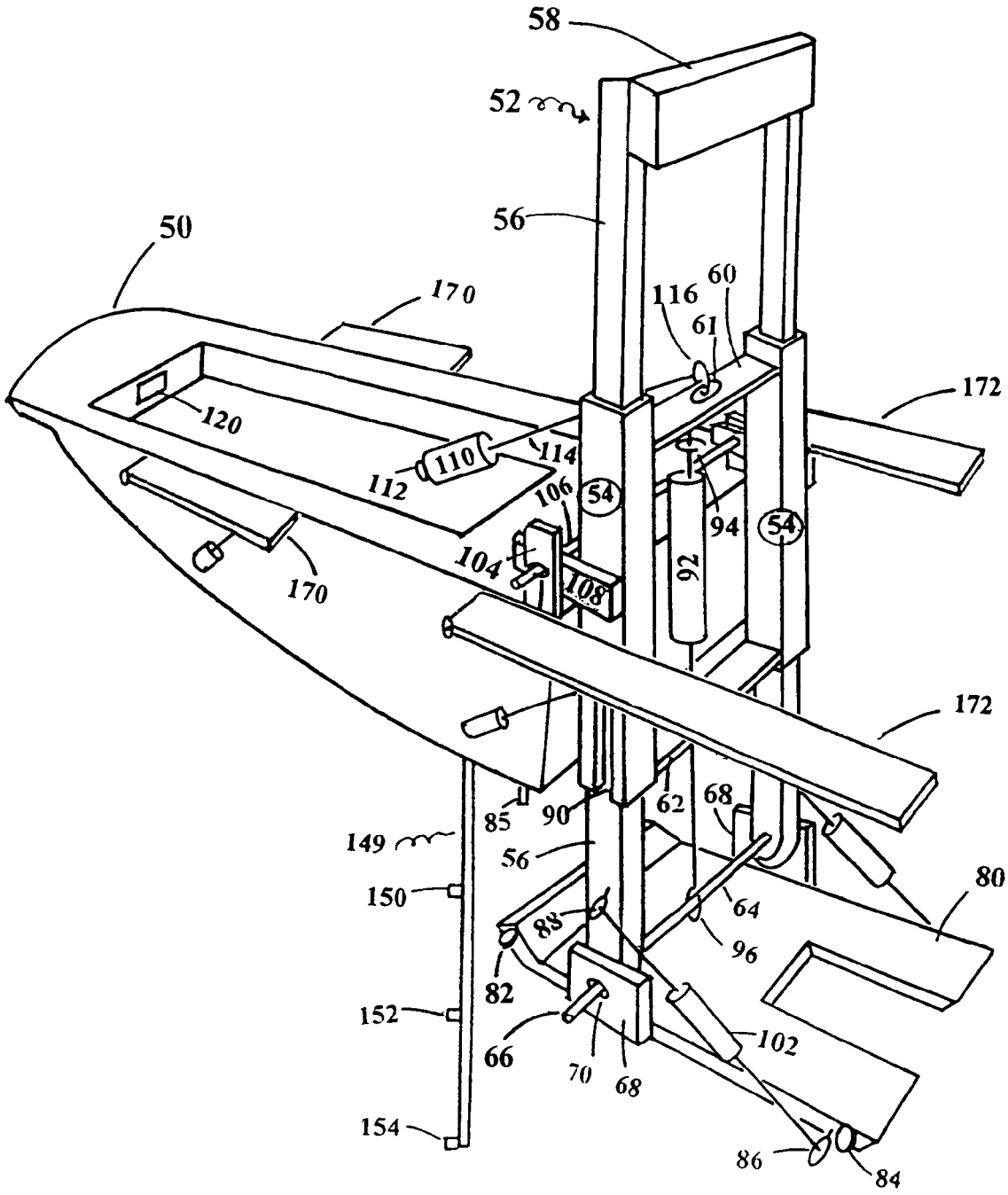
FIG. 11 is a boat which can fly above water surface for installation of a modified engine of high and very high speed.
Figure 12:
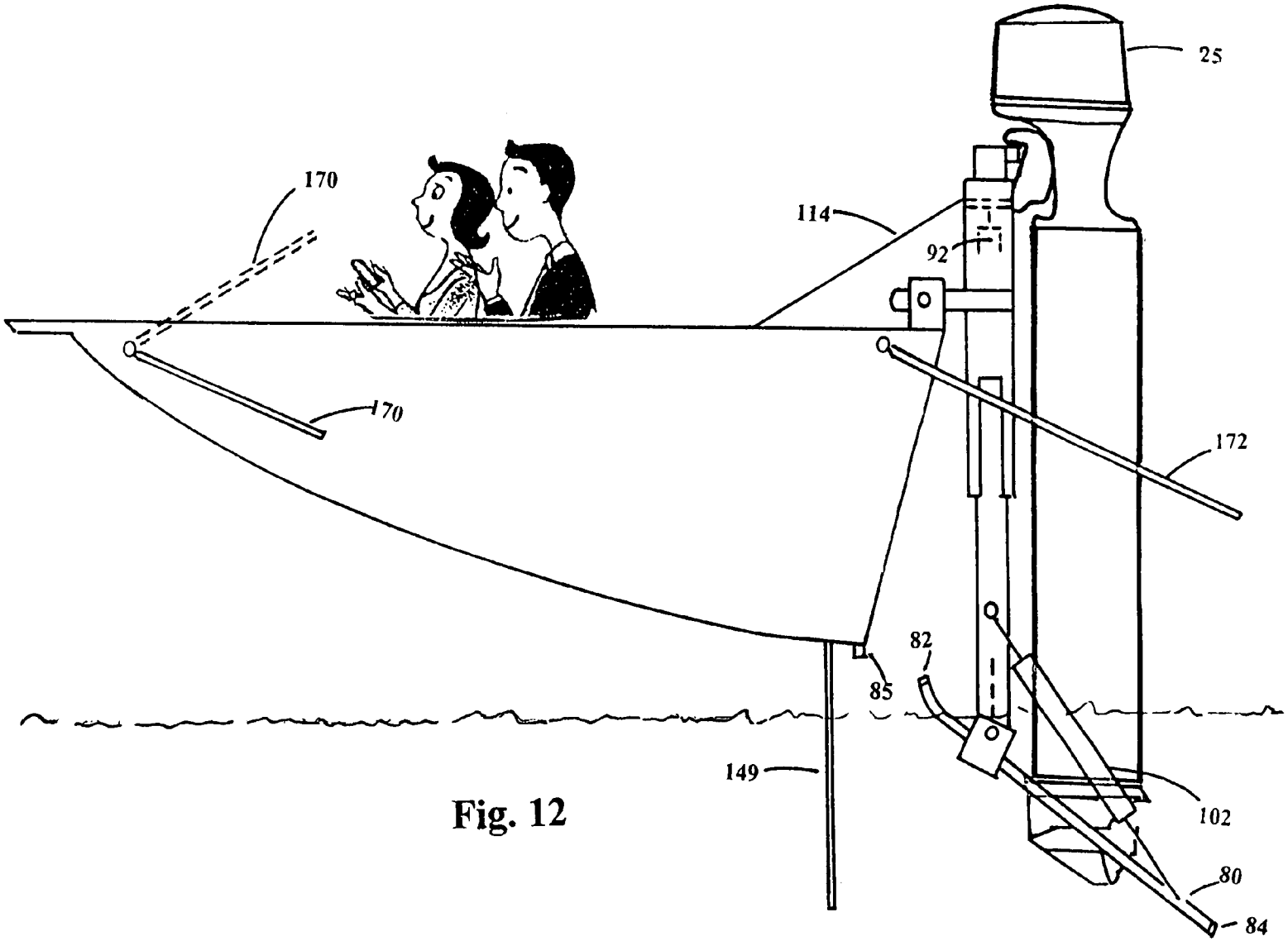
FIG. 12 is a side view of FIG. 11 showing a boat installed a high speed engine.
Figure 13:
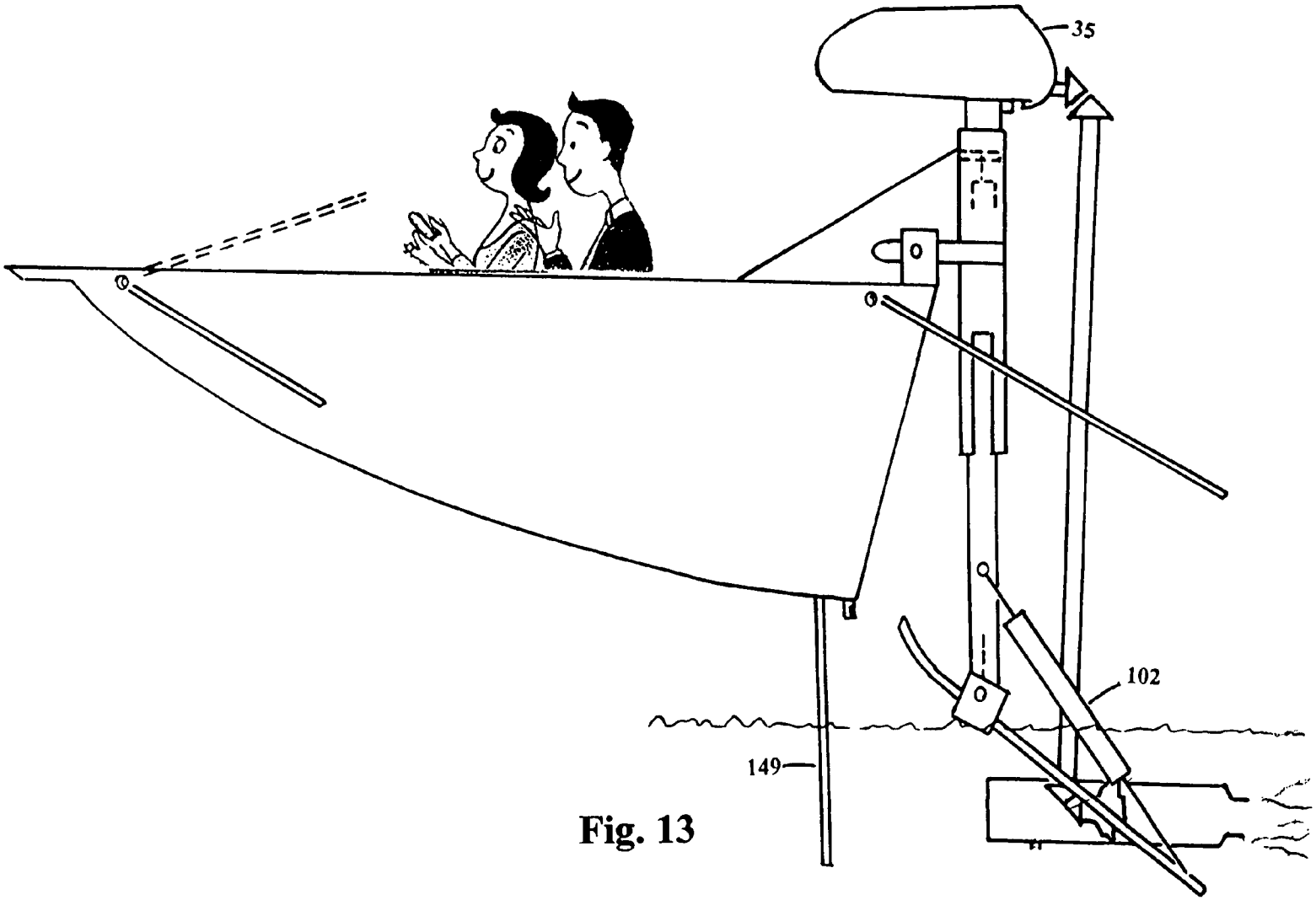
FIG. 13 is a side view of FIG. 11 showing a boat installed a very high speed engine.

According to FIGS. 11-13, to use this mechanism invented described above in constructing a smart flying outboard boat, to allow flying of boat better and in shorter time and to reduce dimension of flaps to be installed, engine used should be engine 25 or 35 which are of faster type to be installed on to steel plate 58 in addition to installing flaps 170 and flaps 172 at the anterior and posterior, respectively, on both sides of the boat. These flaps can be controlled to pivotally move by hydraulic system through pressing a control knob at the control panel.

When boat is moving forward at high speed, it is lifted up further or lowered down slightly due to aerodynamic effect of wind against its front. All the flaps can be controlled to move to a desirable angle together with speed of the boat to have the boat move smoothly at an appropriate level above the water surface.

Since no need any further for boat to carry weight of the engine, if a water jet engine is modified to an outboard engine type, while boat is flying above water surface, the speed might be too high to cause turning of the boat upside down and causes accident. In such situation, flaps 170 must be turned pivotally up to have the wind presses the anterior of boat slightly down to prevent turning of the boat upside down.

If flaps 172 is moved pivotally up, the wind will press the rear end of boat down thus lifting up the front of the boat. This will help lifting up the boat to get above water surface more easily.

Hydraulic element 110 is the part to adjust angle of rectangular metal tubes 54 and thus engine is also tilted. An experienced driver would adjust the engine to an appropriate angle at a different speed or different level above the water surface to get the best power of the propeller in each situation of driving.

Figure 14:
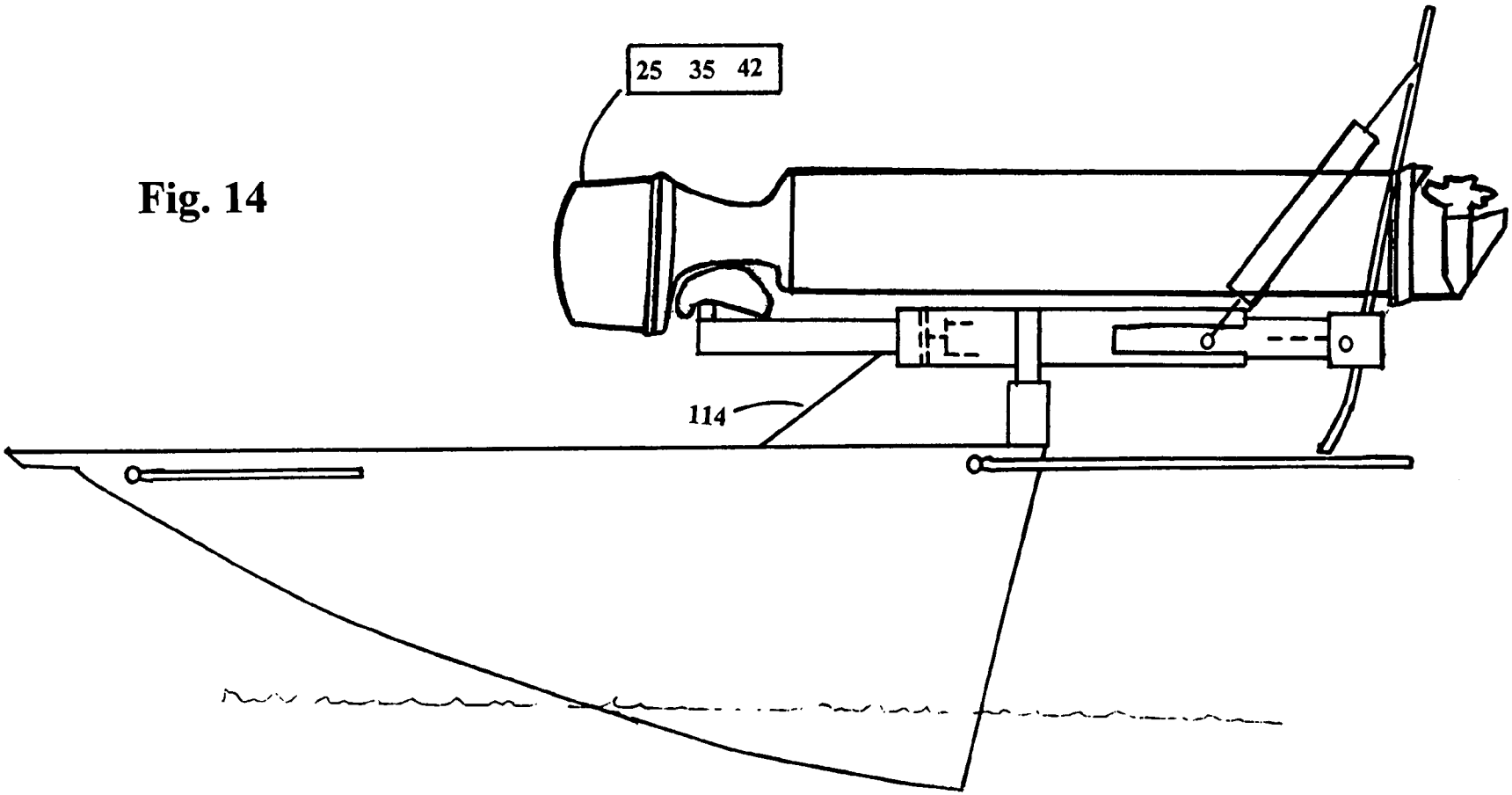
FIG. 14 shows an engine lie horizontally on boat deck when not in use.
Figure 15:
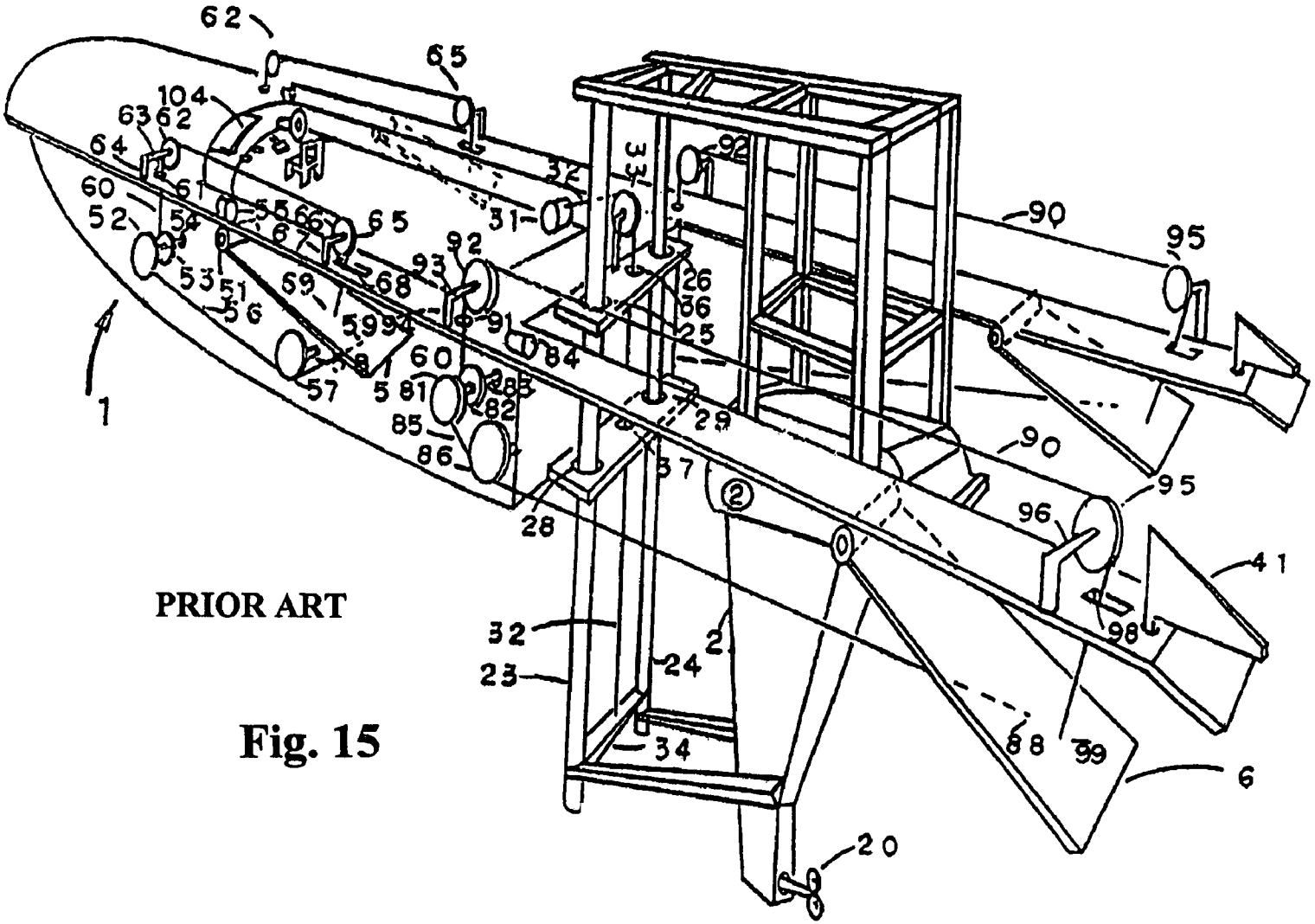
PRIOR ART Fig. 15
FIG. 15 shows flying boat of prior art.

Hydraulic element 110 itself, if stem 114 is extended, mechanism 52 will be pressed tighter to the stern of boat 50. If stem 114 is shortened, mechanism 52 is moved to lie down onto the deck as in FIG. 14 which is a step to keep the engine onto the boat deck while the boat is anchored.

How high is bottom of the boat above water surface is known if switches are installed at different levels along a vertical rod 149 which is mounted to underneath of the boat as shown in FIG. 11. Switches activate the light bulbs at the control panel 120 to light up in a following manner:

At a height >0–0.5 meter, switches 154, 152 and 150 immerse under water, light bulbs 160, 158 and 156 would light up, respectively;

At a height 0.5–<1 meter, switches 154 and 152 immerse under water, light bulbs 160 and 158 would light up;

At a height 1–<1.5 meter, switch 154 immersedunder water, light bulb 160 would light up.

Any electronics or any systems such as sonar system capable of indicating the level of the bottom of boat above water level can also be used.

This mechanism invented in the present invention is a mechanism to transfer the total weight of the engine from the boat to be carried by the ski which was loaded to the stream of water moving underneath the ski. The boat needs not carry to move the engine forward. On the contrary, total weight of engine is transferred to the ski and loaded onto the water. The engine whose propeller rotates under the ski structure and under the water surface would drive the boat forward at all time. The engine can be mounted to any other appropriate position that makes it function efficiently. In each boat, this mechanism can be used as many units as desired. As a matter of fact, it is possible using this mechanism invented with any kind of vehicle either with or without flaps for water transportation which has engine with power high enough to move the vehicle at high speed enough such that aerodynamically the force wind acts upon the front part of boat would cause uplift of the boat hull and thus the whole boat up above water surface. This mechanism helps relief the very heavy weight of the engine from the boat.

In addition, there is yet another advantage of using as outboard engine, i.e. a boat using inboard engine installed the engine in the boat and not at its stern as when the outboard engine is used. Upon outburst of a fire, mostly occur in an engine room which is very difficult to put out and if there is explosion, then the damage would be greater than when an outboard engine is used. The chance that an outboard engine catches fire is scarce and if a fire occurs then it is much easier to put out as the engine is installed outside the boat hull.

It will be understood that modifications can be made in the above description without departing from the scope of this invention by one of ordinary skill in the art. It is accordingly intended that all matter contained in the above description be interpreted as descriptive and illustrative rather than in a limiting sense. It is also to be understood that the following claims are intended to cover all of the generic and specific features of the invention as described herein, and all statements of the scope of the invention which, as a matter of language, might be said to fall therebetween.

We claim:

1. A mechanism for transferring total weight of an outboard engine from a boat to be loaded onto water surface while said boat is moving at a relatively high speed comprises mainly of two parts, first part is to be fixed to said boat and second part to be fixed to an engine where said second part has components to fit into the first part and there is a connecting component between the two parts in such a manner controllable that the second part can either move freely vertically or fixed tightly relative to said first part while said first part is stationary and where there is a ski structure at lower end of said second part and having propelling means of said engine located underneath the ski.

2. A mechanism for transferring total weight of outboard engine from a boat to be loaded onto water surface whose first part to be fixed to boat of claim 1 comprises two rectangular metal tubes positioned vertically where upper part and lower part each connected with thick steel plates;

from underneath said upper thick steel plate, there hung a first hydraulic element down vertically which is component connecting between first part and second part of mechanism and whose function can be controlled readily, outer sidewise from lower end of each tube there is a groove, above said groove is a thick horizontal steel plate mounted its one end to said metal tube one on each tube where two of said thick horizontal steel plates connected to each other by a steel rod having its each end passes through and freely rotates in a circular cavity of thick vertical steel plate mounted to the rear of said boat, from a cavity in said upper thick steel plate, there is a second hydraulic element connects said upper thick steel plate to deck of said boat at the end of stem of said second hydraulic element.

3. A mechanism for transferring total weight of outboard engine from a boat to be loaded onto water surface whose second part to be fixed to an engine of claim 1 comprises two rectangular steel shafts positioned vertically each to fit into said rectangular metal tube of first part in such a manner controlled by said first hydraulic element that they can either be capable of moving freely up and down in said tube or be fixed tightly at any level to said tube, where upper part of said two shafts each connected with thick steel plate to which an engine is mounted onto, at lower end of said shafts there is a ski structure mounted thereto such that said ski can be controlled at any time to pivotally rotate to make a desirable angle to said shafts, and where propelling means of said engine extended that it can freely rotate underneath said ski;

switches are installed to said ski to indicate position of ski relative to water surface.

4. A mechanism for transferring total weight of outboard engine from a boat to be loaded onto water surface of claim 1 whose first part is connected to said second part through a connecting component, in such a manner controllable that, in one situation said second part is held tightly at any level as desired and stationary to said first part, yet in another situation said second part can move freely up and down relative to said first part.

5. A mechanism of claim 1 to be used with a boat or a ship to allow relief the weight of boat engine.

* * * * *